US007230581B2

(12) United States Patent
McEwan

(10) Patent No.: US 7,230,581 B2
(45) Date of Patent: Jun. 12, 2007

(54) NOMADIC STORABLE SATELLITE ANTENNA SYSTEM

(75) Inventor: George Tyler McEwan, Centerville, UT (US)

(73) Assignee: Winegard Company, Burlington, IA (US)

( * ) Notice: Subject to any disclaimer, the term of this patent is extended or adjusted under 35 U.S.C. 154(b) by 2 days.

(21) Appl. No.: 11/195,975

(22) Filed: Aug. 3, 2005

(65) Prior Publication Data

US 2007/0013604 A1 Jan. 18, 2007

Related U.S. Application Data

(60) Provisional application No. 60/601,362, filed on Aug. 13, 2004.

(51) Int. Cl.
*H01Q 1/32* (2006.01)
*H01Q 1/10* (2006.01)

(52) U.S. Cl. ..... 343/882; 343/711; 343/766

(58) Field of Classification Search ..... 343/711, 343/713, 765, 766, 878, 881, 882
See application file for complete search history.

(56) References Cited

U.S. PATENT DOCUMENTS 3,412,404 A * 11/1968 Bergling ..... 343/762
4,663,633 A 5/1987 Wilson
4,725,843 A 2/1988 Suzuki et al.
4,771,293 A 9/1988 Williams et al.
4,811,026 A 3/1989 Bissett
4,873,526 A 10/1989 Katsuo
4,887,091 A 12/1989 Yamada
4,994,816 A 2/1991 Kondo
5,337,062 A * 8/1994 Sherwood et al. ..... 343/711
5,418,542 A * 5/1995 Sherwood et al. ..... 343/711
5,515,065 A 5/1996 Sherwood et al.
5,528,250 A * 6/1996 Sherwood et al. ..... 343/711
5,554,998 A 9/1996 Sherwood et al.
5,646,638 A 7/1997 Winegard et al.
5,929,817 A 7/1999 Clark
5,952,980 A * 9/1999 Boling ..... 343/766
5,999,139 A * 12/1999 Benjamin et al. ..... 343/765
6,124,836 A 9/2000 Rogers
6,462,718 B1 10/2002 Ehrenberg et al.
6,535,177 B1 3/2003 Dhellemmes et al.
2004/0160375 A1 8/2004 King

* cited by examiner

*Primary Examiner*—Tan Ho
(74) *Attorney, Agent, or Firm*—Dorr, Carson & Birney, P.C.

(57) ABSTRACT

An elevation mechanism for a satellite antenna system allows the antenna to be moved between a deployed position and a stowed position. The elevation mechanism includes a lift bar driven by a motor having one end pivotally connected to the back of the antenna and a pivot connection point pivotally connected to the base of the satellite antenna system. A tilt link bar has a first end pivotally connected to the back of the antenna and a second end pivotally connected to the base. The tilt link bar causes the antenna to pivot as the antenna moves between the stowed position and the deployed position so that in the stowed position the antenna faces downward.

14 Claims, 8 Drawing Sheets

NOMADIC STORABLE SATELLITE ANTENNA SYSTEM

RELATED APPLICATION

The present application is based on, and claims priority to the Applicant's U.S. Provisional Patent Application Ser. No. 60/601,362, entitled "Nomadic Storable Satellite Antenna System," filed on Aug. 13, 2004.

BACKGROUND OF THE INVENTION

1. Field of the Invention

The present invention relates to a mobile satellite antenna system mounted on the rooftop of a vehicle that can be quickly deployed and targeted on a satellite or stowed for transport.

2. Prior Art

The mobile satellite antenna market is growing due to the increased demand for high bandwidth communication between a vehicle and a satellite. For example, recreational vehicle users travel with laptop computers and desire high bandwidth access to the Internet. Commercial users such as those who are, for example, found in the oil and gas industry with mobile vehicles traveling from one location to another in the field have the same need.

Some users of mobile satellite antennas require high speed deployment of the satellite antenna such as those who are, for example, found in the law enforcement community with their tactical communications vehicles. Military and homeland security units have the same requirement. In some geographical areas, the mobile satellite antenna is required to move through heavy snow loads in its deployment.

A number of conventional satellite antenna systems are available that fold down onto rooftops of vehicles. Conventionally, either gear boxes are used in such conventional systems to elevate the dish through a rotary drive motion, or a linear actuator attached to the back of the satellite dish is used to raise the dish by pivoting on a cardanic joint. Examples of such commercially available devices are those found in U.S. Pat. Nos. 5,337,062, 5,418,542 and 5,528,250. In addition, such conventional satellite antenna systems are available from MotoSat and C-Com Satellite Systems, Inc.

A need exists to move the satellite antenna system from a stowed position to a usable deployed position as quickly as possible and to overcome any lethargic mechanical performance. Conventional drive gear box designs are slower in operation and suffer from an undesirable condition called gear backlash that may adversely affect data transmission and use of the dish. A conventional linear actuator, at the attachment point on the satellite dish, provides a limited range of elevation motion and cannot be used in every region of the world.

A need exists for a stowable/deployable satellite antenna system that does not encounter excessive backlash as found in gear box designs and does not limit range of elevation as found in cardanic joint-based actuators. A further need exists to rapidly deploy the satellite antenna system. A final need exists to deploy the satellite antenna system under heavy loads such as found when heavy snow accumulates on the stowed antenna and the antenna must be deployed through the heavy snow load.

SUMMARY OF THE INVENTION

This invention provides an elevation mechanism for a satellite antenna system that allows the antenna to be moved between a deployed position and a stowed position. The elevation mechanism includes a lift bar driven by a motor having one end pivotally connected to the back of the antenna and a pivot connection point pivotally connected to the base of the satellite antenna system. A tilt link bar has a first end pivotally connected to the back of the antenna and a second end pivotally connected to the base. The tilt link bar causes the antenna to pivot as the antenna moves between the stowed position and the deployed position so that in the stowed position the antenna faces downward.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
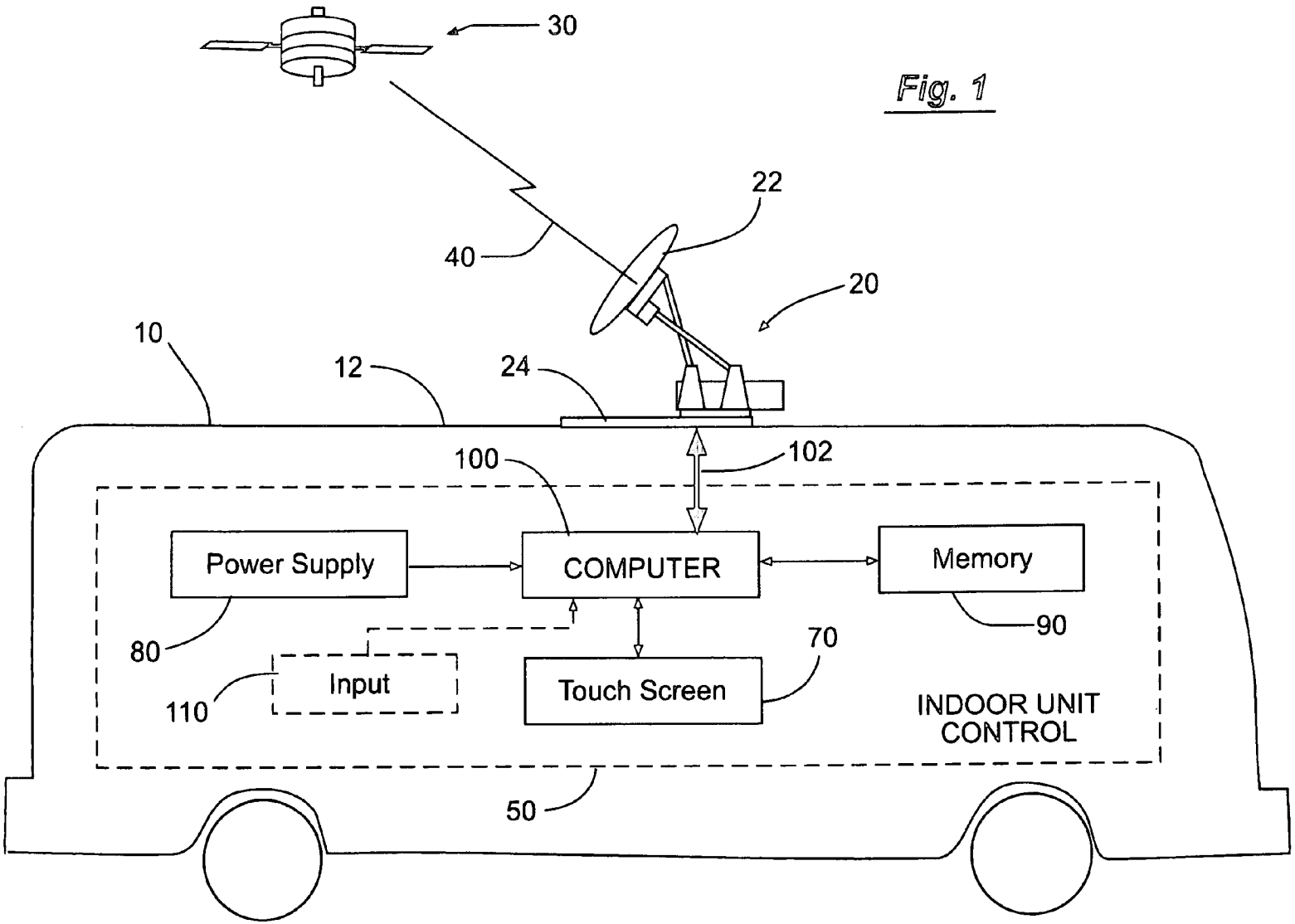
FIG. 1 shows the satellite antenna system 20 of the present invention mounted to a vehicle in operational use.

Overview of Use. In FIG. 1, a vehicle 10 is shown having a roof-mounted satellite antenna system 20 in communication with a satellite 30 to broadcast and receive signals 40. In the interior of the vehicle 10 is an indoor unit control 50 for controlling over cable(s) 102 the operation of the satellite antenna system 20 and the communication with the satellite 30. The indoor unit control 50 has a computer 100, a touch screen 70, and a power supply 80. These components are conventionally available and are suitably designed to work with other hardware interfaces and software controls to conventionally stow and deploy the dish antenna 22 of the satellite antenna system 20 that is mounted 24 to the roof 12 of the vehicle 10. The accompanying drawings illustrate a conventional dish antenna 22, but it should be understood that other types of satellite antennas could be used in the present invention.

It is to be understood that a number of different conventional indoor unit controls 50 are available to control a number of different satellite antenna systems 20. The present invention is vigorous in that it can be adopted to work with any such conventional system to secure access for deployment and stowing of the satellite antenna system 20 on the vehicle 10.

Figure 2:
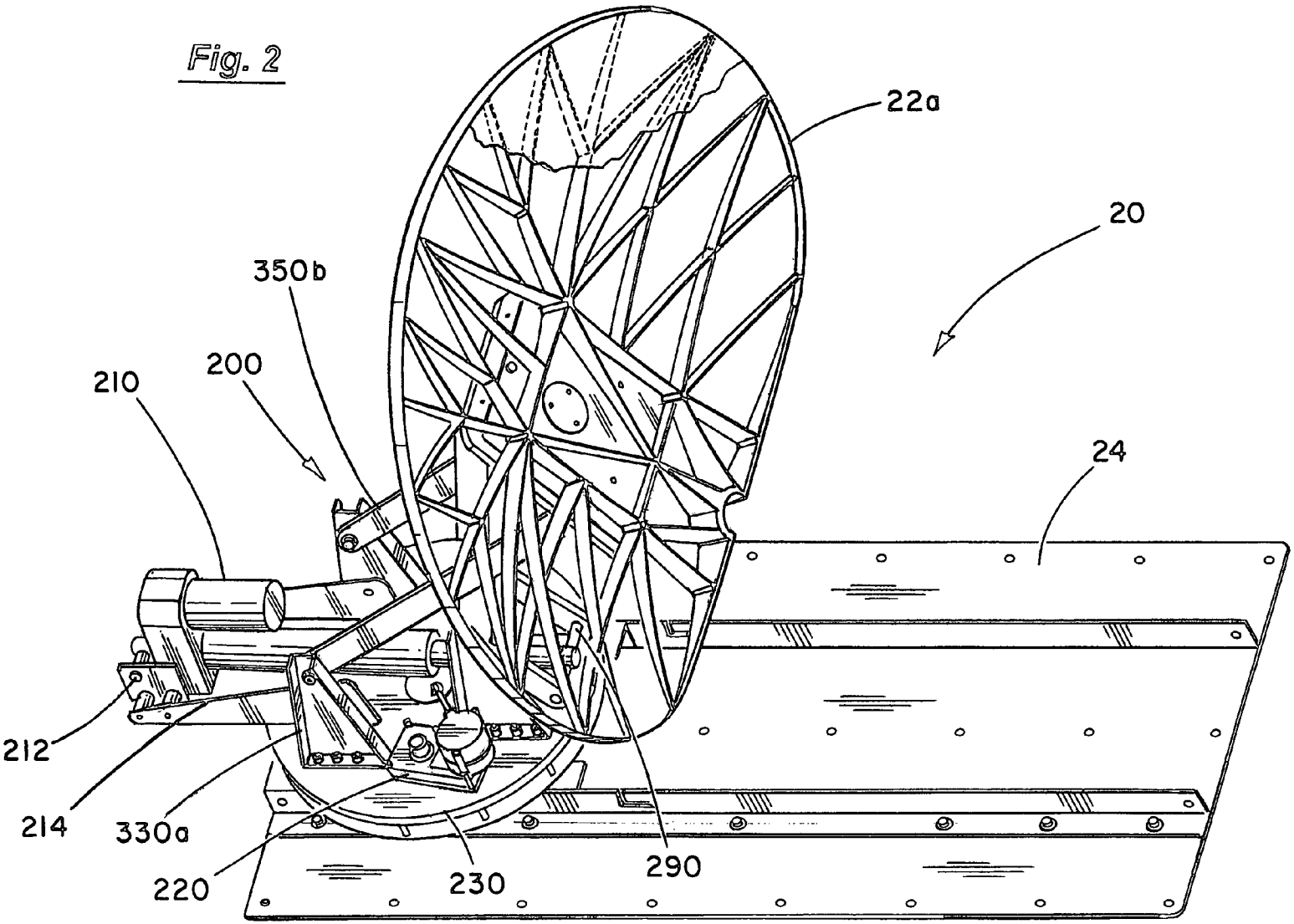
FIG. 2 is a perspective view of the elevation mechanism 200 of the present invention mounted in a satellite antenna system.

Overview of Satellite Dish Antenna. In FIG. 2, the details of the satellite antenna system 20 are shown without the dish 22 being shown. The dish back structure 22*a* for the dish 22 connects to the elevation mechanism 200 of the present invention. A linear actuator 210 is used to deploy and stow the dish 22 mounted to the dish back structure 22*a*. The linear actuator 210 is conventionally connected to a bracket 214 on the movable azimuth plate 230 such as with a steel link pin 212. An azimuth drive motor 220 is connected directly to the movable azimuth plate 230. The azimuth plate 230 provides a stable mounting platform for all of the elevation mechanism 200 components and is designed to rotate 360° freely about a center axis so as to provide a full 360° rotational travel for the satellite antenna system 20. It should be understood that other means for mounting the satellite antenna system 20 could be readily substituted for the azimuth drive motor 220. In general terms, the satellite antenna system 20 can be mounted to any type of base.

Figure 3:
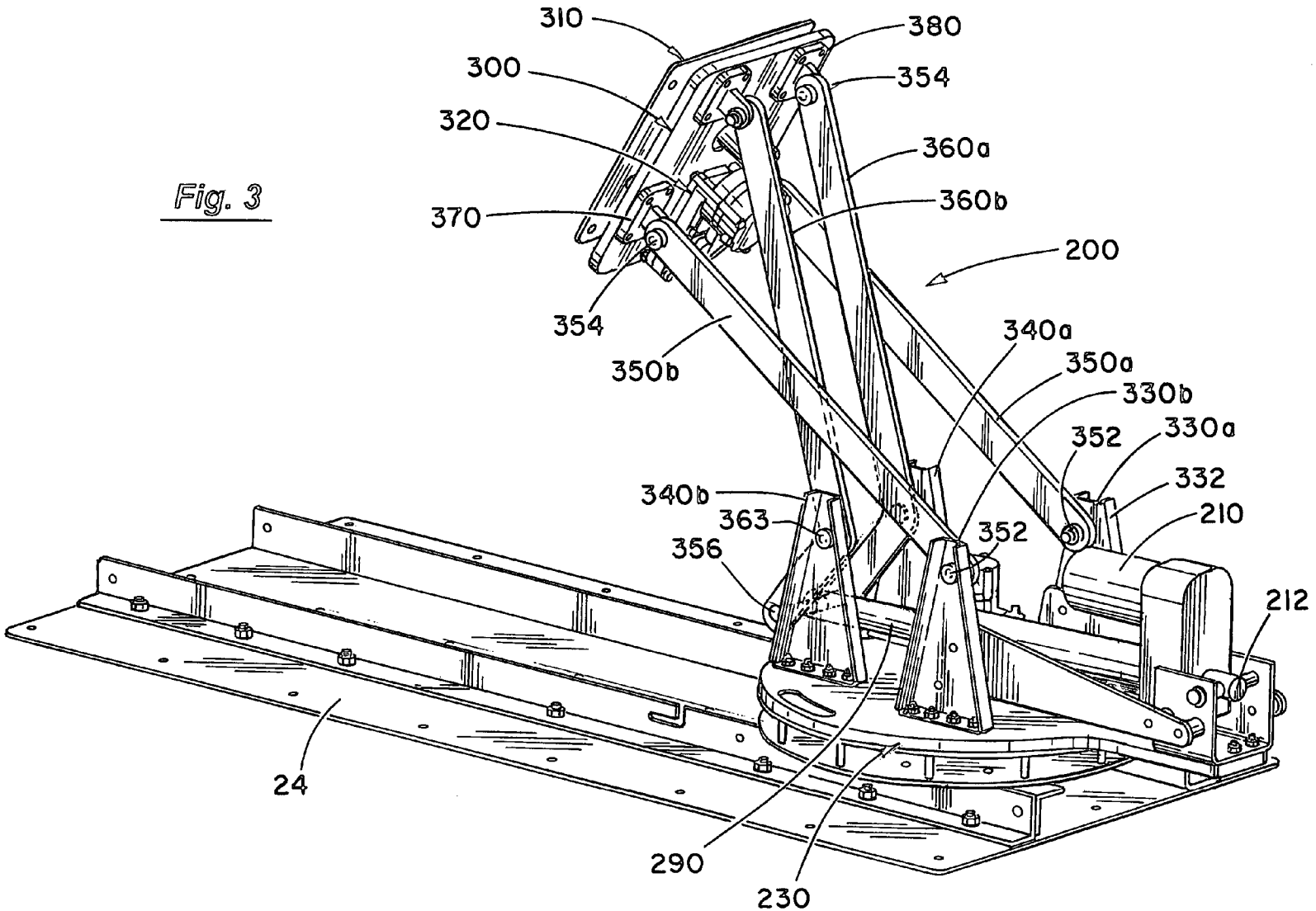
FIG. 3 is a perspective illustration of the elevation mechanism 200 of the present invention mounted to the azimuth plate of a satellite antenna system.

As shown in FIG. 3, the elevation mechanism 200 is shown connected at one end to a dish back plate 300 that carries a skew plate 310 that is designed to rotate about the center axis of the dish back plate 300. The rotation is caused by a skew motor 320 that is mounted to the dish back plate 300. The mechanical output shaft of the skew motor 320 is connected to the skew plate 310 to drive the skew plate 310 about the third axis of movement required for operation of the satellite antenna system 20. The dish back structure 22*a* for the satellite antenna system 20 is mounted to the skew plate 310.

In the above embodiment, the details of the mounting plate 24, the movement of the dish antenna 22 in the azimuth direction by means of the azimuth plate 230, and the movement of the dish under control of the skew motor 320 can be of any of a number of suitable designs and are not limited to that shown here which for purposes of the present disclosure is illustrated. The elevation mechanism 200 of the present invention will now be explained in greater detail.

Elevation Mechanism. In FIG. 3, the elevation mechanism 200 of the present invention is shown mounted to the azimuth plate 230 (or base) by means of two opposing tilt pivot brackets 330*a* and 330*b* and two opposing lift pivot brackets 340*a* and 340*b*.

The tilt pivot brackets 330*a* and 330*b* oppose each other and function to precisely locate the tilt link bars 350*a* and 350*b*, which are used to create pivoting motion to the dish 22 during movement between the stowed position and the deployed position. Each tilt pivot bracket 330*a* and 330*b* is generally triangular in shape, and the base of each triangle is mounted to the azimuth plate 230. How the pivot brackets 330*a* and 330*b* are mounted to the azimuth plate 230 is immaterial as any of a number of conventional approaches can be utilized including the four bolted connections shown in FIG. 3. Each tilt pivot bracket 330*a* and 330*b* has extending sides 332 around the periphery to provide rigidity for the bracket 330*a*, 330*b*. Each tilt link bar 350*a* and 350*b* is pivotally connected 352 to its corresponding tilt pivot bracket 330*a* or 330*b*. Again, any of a number of conventional pivot connections 352 can be utilized to provide pivotal movement between each tilt link bar 350*a*, 350*b* and each tilt pivot bracket 330*a*, 330*b*.

Figure 5:
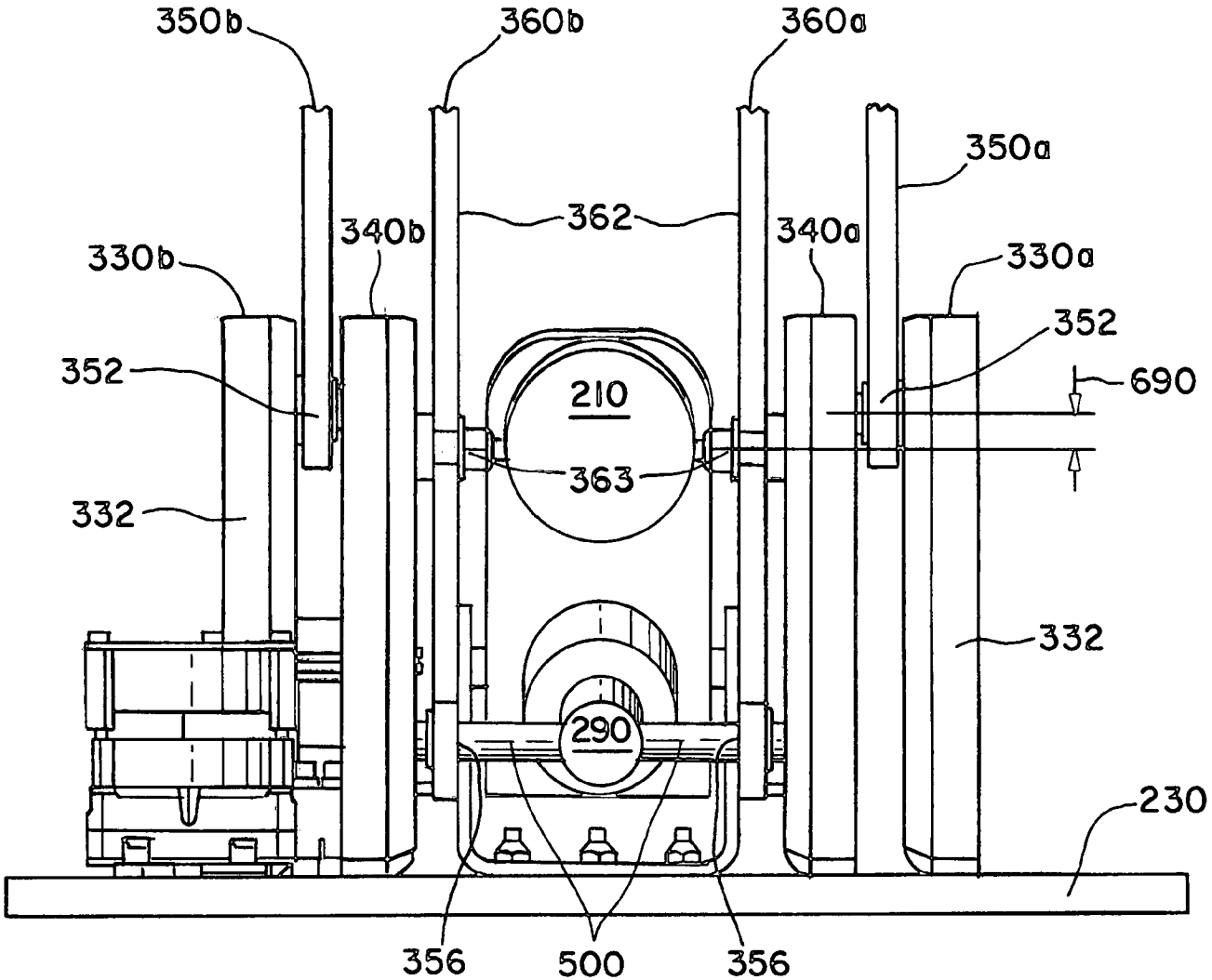
FIG. 5 is a side planar view of the elevation mechanism 200 of the present invention mounted to the azimuth plate of a satellite antenna system.
Figure 6:
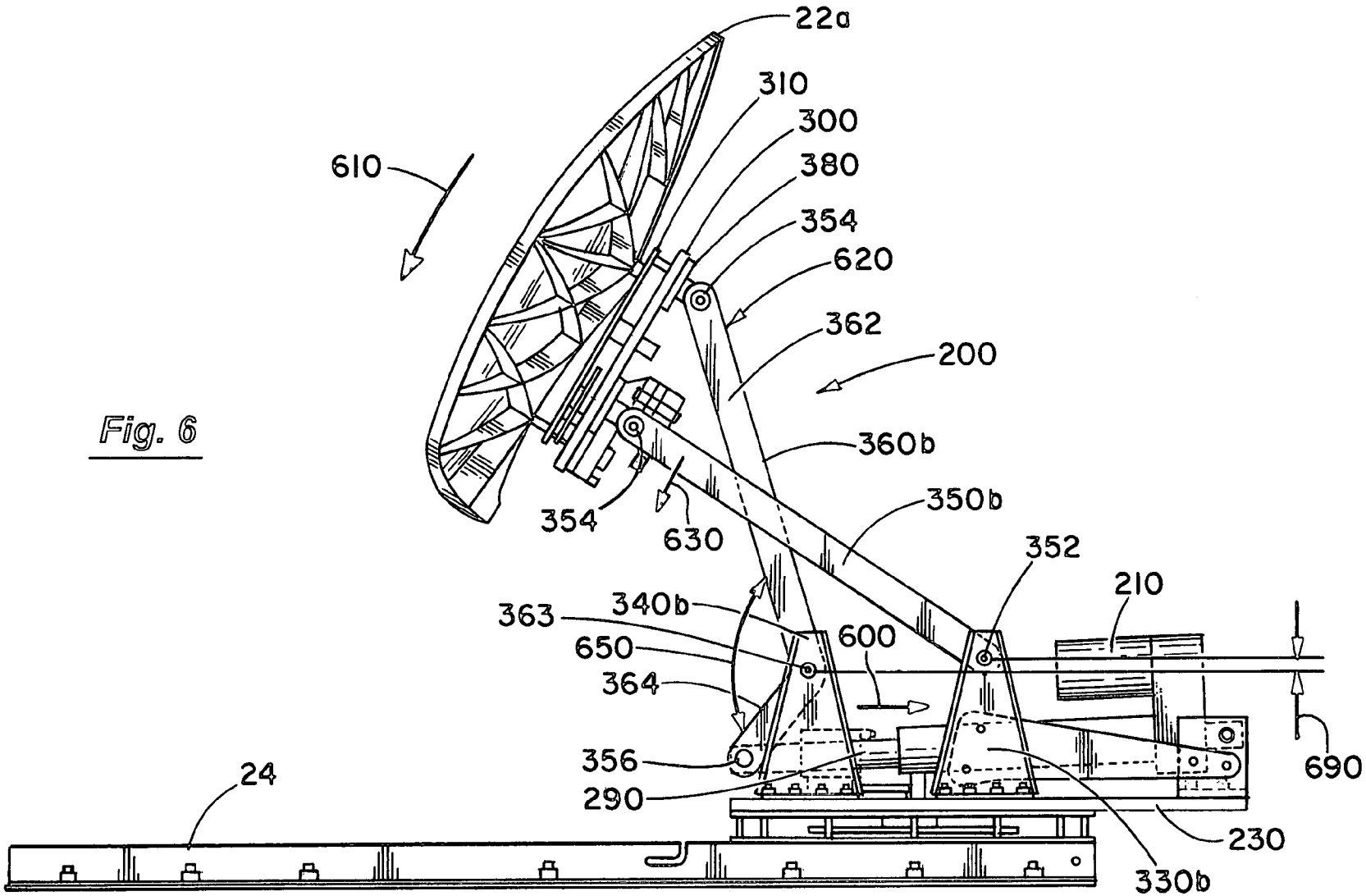
FIG. 6 is a side planar view of the elevation mechanism 200 deploying the satellite antenna system.

Likewise, each lift pivot bracket 340*a* and 340*b* is of the same or similar design as each tilt pivot bracket 330*a* and 330*b* and is connected to the azimuth plate 230 (or base) in the same or similar fashion. However, the tilt pivot connection point 352 location is higher 690 (as shown in FIGS. 5 and 6) than the lift pivot connection point 363. A mathematical relationship exists between the two separate pivot locations to provide proper pivoting and lifting. Each lift bar 360*a* and 360*b* of the elevation mechanism 200 is connected to respective lift pivot brackets 340*a* and 340*b* in the same or similar fashion as the connection of the tilt link bars 350*a* and 350*b* to the respective tilt pivot brackets 330*a* and 330*b*. The lift pivot brackets 340*a* and 340*b* are located precisely on the azimuth plate 230 (or base) with the function of providing a pivot location for the lift bars 360*a* and 360*b* in the elevation mechanism 200.

Figure 4:
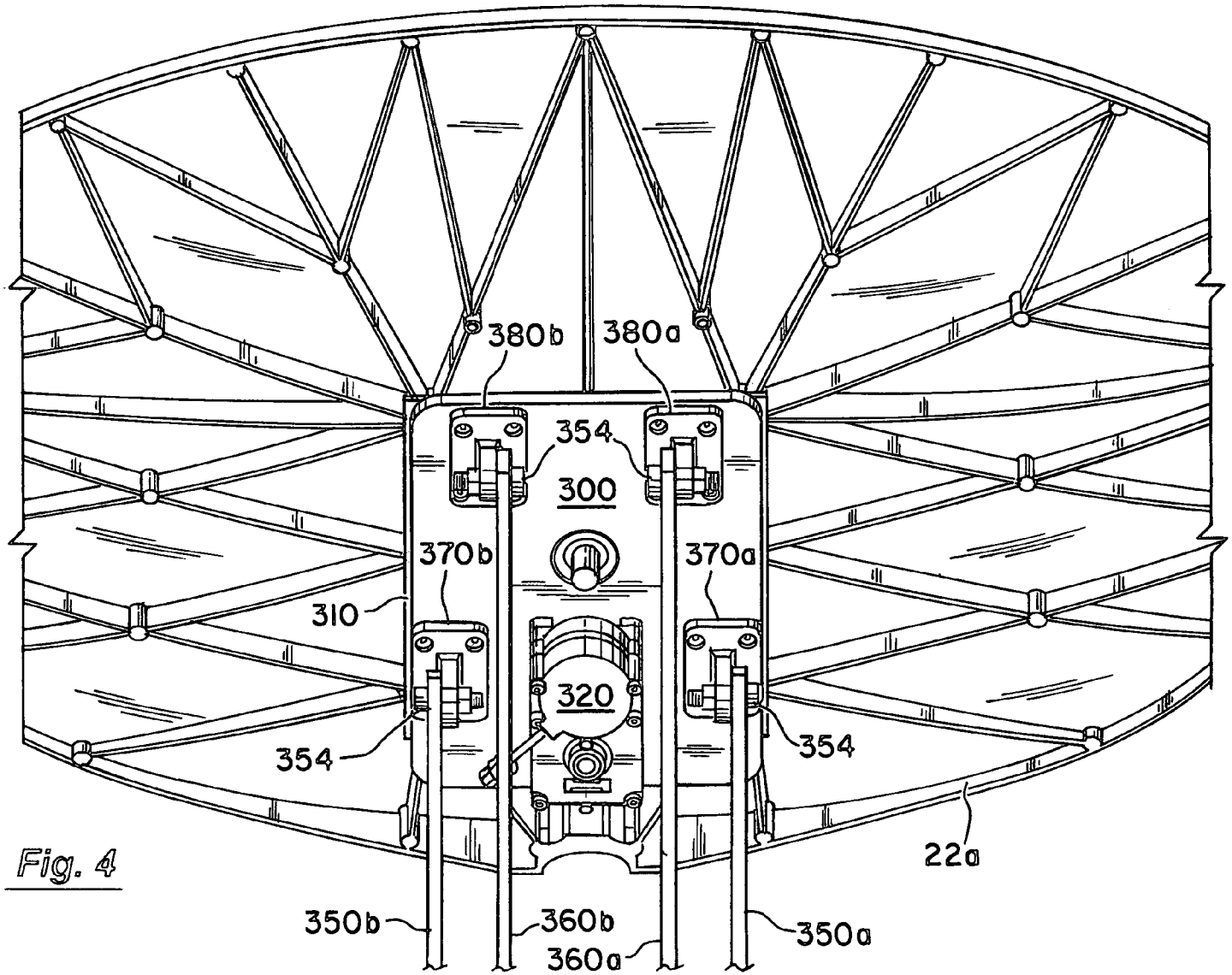
FIG. 4 is a side planar view of the connection of the elevation mechanism 200 to the dish back plate.

Each tilt link bar 350*a* and 350*b* is an elongated substantially rectangular mechanical arm having curved ends as shown in FIG. 3. At each end of each tilt link bar 350*a*, 350*b* is a hole, not shown, through the bar that cooperates with pivot connection 352 at the end of the bar that connects to the tilt pivot brackets 330*a* and 330*b*. A hole at the opposite end of each tilt link bar 350*a*, 350*b* cooperates with a second pivot connection 354. This second pivot connection 354 is to a rigid upstanding dish back plate pivot bracket 370 firmly attached to the dish back plate 300 as shown in FIG. 4. Each dish back plate pivot bracket 370 is firmly connected to the dish back plate 300 in any of a number of conventional fashions. The connections could include, for example, a bolted connection, a welded connection, an integral connection such as die cast part, etc.

It can be observed in FIG. 3 that the two lift bars 360*a* and 360*b*, in this embodiment, are disposed between the two tilt link bars 350*a* and 350*b*. This is better shown in FIG. 4. Likewise, in FIG. 5, the positioning of the lift bars 360*a* and 360*b* inside of the tilt link bars 350*a* and 350*b* is shown with respect to the pivotal connection 352 to the tilt pivot brackets 330*a* and 330*b* and to the lift pivot brackets 340*a* and 340*b* that are mounted to the azimuth plate 230. In another embodiment, the tilt link bars 350*a* and 350*b* are located inside the lift bars 360*a* and 360*b*. It should be understood that the number and relative locations of the lift bars 360*a*, 360*b* and tilt link bars 350*a*, 350*b* are largely matters of design choice. For example, an elevation mechanism could be constructed with two tilt link bars 350*a*, 350*b* and only one lift bar.

In the embodiment of the present invention shown in the accompanying figures, each lift bar 360*a* and 360*b* comprises two bar segments 362 and 364 (e.g., as shown in FIGS. 5 and 6). Segments 362 and 364 are integral in each bar 360*a* and 360*b*. Where the two segments 362 and 364 meet is located the formed hole, not shown, corresponding to the pivot connection point 363. With reference to the lift bar that is shown as 360*b* in FIG. 6, the angular relationship, between the two segments 362 and 364 is shown. Preferably, an obtuse angle 650 exists between the two segments 362 and 364. The end of segment 364 has a formed hole, not shown, cooperating with a pivot connection 356 that connects to the drive 290 of the linear actuator 210. However, it should be understood that an obtuse angle between the two segments 362 and 364 is not necessary. For example, the segments 362, 364 could be co-linear.

Figure 7:
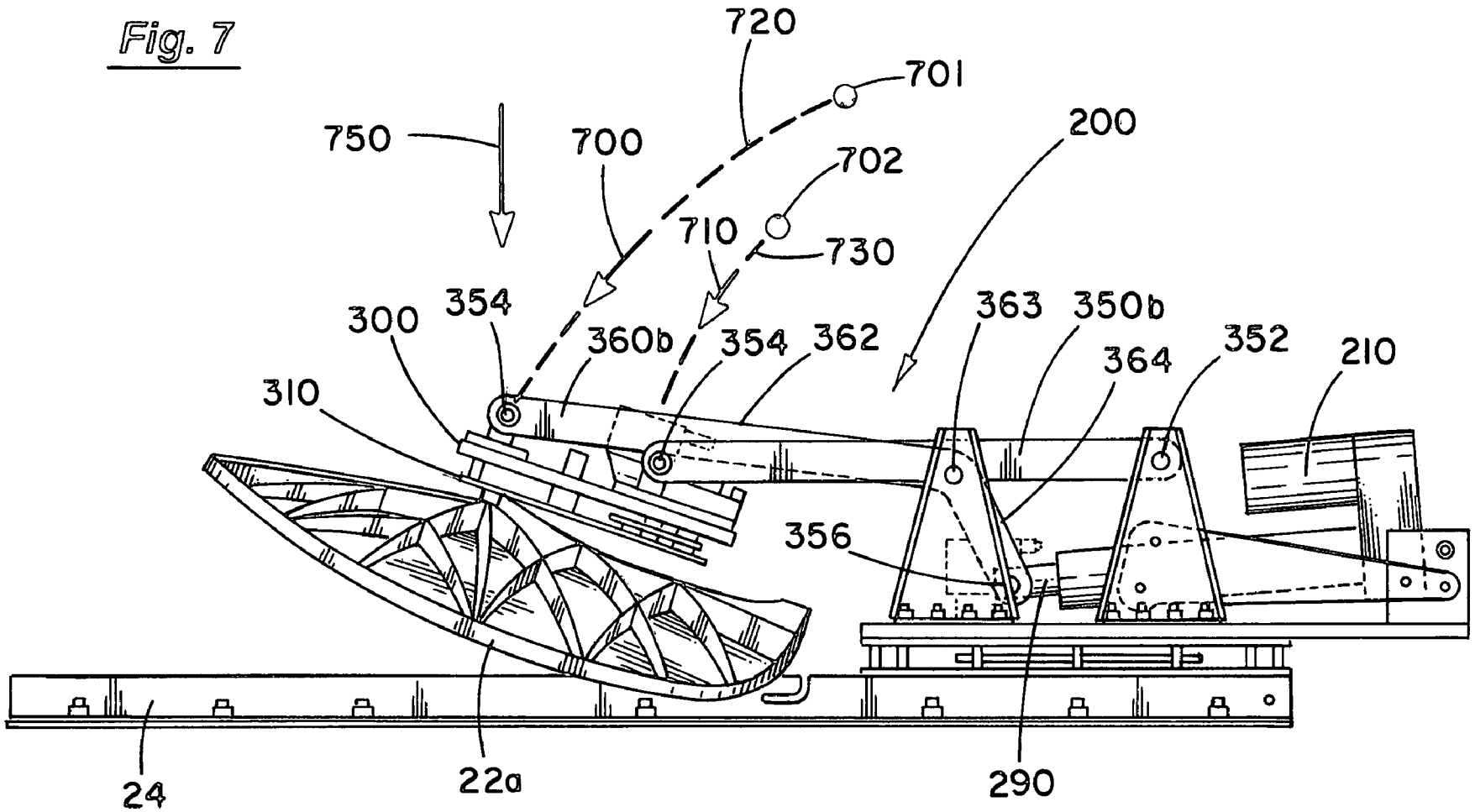
FIG. 7 is a side planar view of the elevation mechanism 200 of the present invention stowing the satellite antenna system.

Operation. With references to FIGS. 6 and 7, the operation of the elevation mechanism 200 is set forth. When the drive 290 of the linear actuator 210 moves in a direction of arrow 600 (FIG. 6) (i.e., substantially parallel to the plane of the azimuth plate 230) the dish back structure 22*a* moves in the direction of arrow 610 until the dish 22 is stowed against or near the mounting bracket 24 as shown in FIG. 7. Action of the drive 290 in the direction of arrow 600 under control of the linear actuator 210 provides a force on lift bars 362*a* and 362*b* in the direction of arrow 620, which causes rotation of the lift bars about the pivot connection point 363 to pull the dish back structure 22*a* in the direction of arrow 610. This force 620 in turn causes a similar force 630 on the tilt link bars 350*a* and 350*b* at pivot point 354. Hence a controlled movement in the direction of arrow 600 occurs until the stowed position of FIG. 7 is obtained. Movement of the drive 290 under control of the linear actuator 210 in the opposite direction of arrow 600 deploys dish back structure 22*a* until the position of deployment shown in FIG. 6 is obtained (or any other desired angle of deployment).

In FIG. 7, arrows 700 and 710 show the paths 720 and 730, respectively, of the ends of bars 360 and 350 at pivot points 354, respectively. The end of the tilt link bar 350*b* (as represented at connection point 354 in FIG. 7) travels along path 730 as shown by arrow 710 to the stowed position from the deployed position 702 of FIG. 6. Likewise, the end of lift bar 360*b* (at pivot point 354) travels along path 720 as shown by arrow 700 from the deployed position 701 of FIG. 6 to the stowed position of FIG. 7.

Also shown in FIG. 7 is a force 750 that could in the normal situation simply be the force of gravity exerting downwardly on the elevation mechanism 200 of the present invention. This force 750, in the case of gravity, is a constant force applied downwardly on the elevation mechanism 200 not only in the stowed position of FIG. 7 but also in the deployed position of FIG. 6.

This force 750 acts to keep any mechanical tolerances (or mechanical slack) constantly biased in the same direction, which therefore does not have to be compensated for when targeting onto a satellite nor does the force 750 impede the quick deployment of the satellite antenna system 20 from the stowed position of FIG. 7 to the deployed position of FIG. 6. In the situation in which the force 750 is greater than the force of gravity due to, for example, a heavy snow load, the present invention through use of the linear actuator 210 lifts against the heavy snow load to place the satellite antenna system 20 in the deployed position of FIG. 6. Each lift bar 360*a* and 360*b* has the angular relationship 650 between segments 362 and 364. Segment 364 is shorter, and a mechanical disadvantage is created between the linear actuator 210 and the dish 22. This allows segment 362 to be as long as possible. The result is a thrust loss due to shorter segment 364. For example, if the lift actuator 210 provides a 500-pound thrust, the lift at the dish 22 is 80 pounds of usable thrust. The dish 22 and the snow load, however, are less than the total lifting capacity of the satellite antenna system 20, so the dish 22 is lifted up. And as the dish 22 goes up, the snow sloughs off the back of the dish 22, making the mechanical load lighter as the satellite antenna system 20 continues up thereby improving the situation.

The connection of the drive 290 to the lower segment 364 of each lift bar 360*a* and 360*b* is best shown in FIG. 5. Here, the drive 290 of the linear actuator 210 is connected to a link pin 500 the ends of which engage in a pivot connection 356 with segments 364. Again, any of a number of conventional connections other than the link pin 500 could be used to provide a pivotal connection 356 between the drive 290 and the lower segments 364.

It is to be expressly understood that the present invention details the operation of the elevation mechanism 200 of the present invention in a satellite antenna system 20 and that the details of the mechanical movement in the azimuth direction, the skew movement and the actual satellite dish 22 have been illustrated and that any of a number of suitable different actual designs could be incorporated and used with the elevation mechanism 200 of the present invention. Furthermore, details of the elevation mechanism 200 of the present invention have been set forth in the drawings and discussed above with respect to one embodiment and it is to be expressly understood different mechanical embodiments could be used in accordance with the teachings of the present invention.

Figure 8:
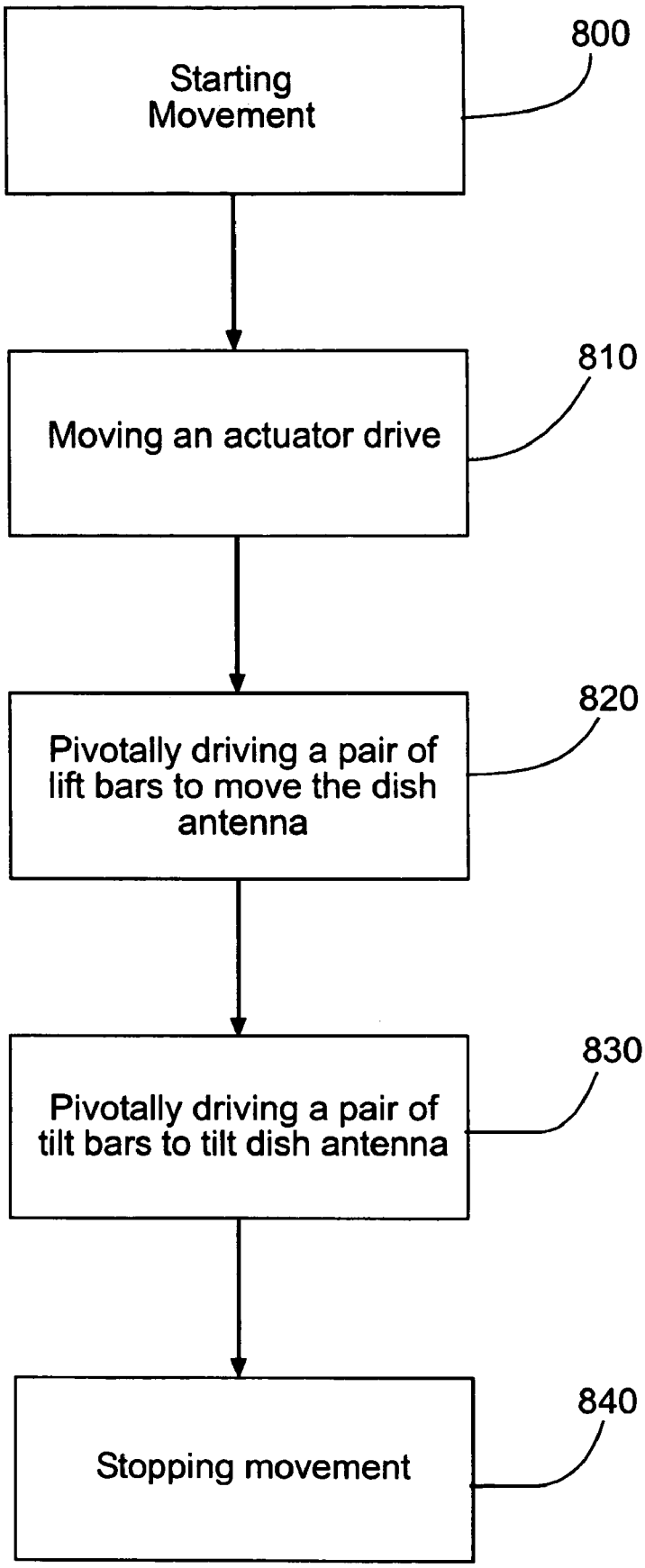
FIG. 8 is a flow diagram of the method of the present invention.

Method. In FIG. 8, the method of the present invention is set forth. In FIG. 8, when it is desired to deploy the satellite antenna system 20 from a stowed position (or vice versa), the user provides a suitable input 110 to the computer 100 (as shown in FIG. 1) to start movement 800. The linear actuator 210 is activated in stage 810 to move the actuator drive 220 in the desired direction. The movement of the actuator drive 220 causes the pivotal driving 820 of the pair of lift bars 360*a* and 360*b* to move the dish 22 (for example arrow 700 in FIG. 7) and to provide a corresponding pivotal driving 830 on the pair of tilt pivot bars 350*a* and 350*b* to cause the satellite antenna system 20 to tilt (as shown by, for example, arrow 710 in FIG. 7). Once at the desired location, in stage 840 the linear actuator 210 is deactivated.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A satellite antenna system comprising:

a base;

an antenna having a front and a back; and an elevation mechanism moving the antenna between a deployed position and a stowed position in which the front of the antenna faces downward, said elevation mechanism having:

(a) a motor;

(b) a lift bar driven by the motor having a first end pivotally connected to the back of the antenna and a pivot connection point pivotally connected to the base; and (c) a tilt link bar having a first end pivotally connected to the back of the antenna and a second end pivotally connected to the base, said tilt link bar causing the antenna to pivot as the antenna moves between the stowed position and the deployed position so that in the stowed position the antenna faces downward.

2. The system of claim 1 wherein the motor comprises a linear actuator motor.

3. The system of claim 2 wherein movement of the linear actuator motor is in a substantially horizontal plane.

4. The system of claim 1 wherein the base further comprises an azimuth plate.

5. The system of claim 1 wherein the lift bar further comprises a second end driven by the motor.

6. The system of claim 5 wherein the pivot connection point is between the first and second ends of the lift bar.

7. The system of claim 5 wherein the lift bar further comprises two segments extending from the pivot connection point to form an obtuse angle.

8. A method of moving a satellite antenna between a stowed position and a deployed position, said method comprising:

providing an actuator with movement substantially parallel the plane of a base on the satellite antenna;

pivotally moving a lift bar having a first end pivotally connected to the back of the antenna and a second end connected to the actuator; and pivotally moving a tilt link bar in response to movement of the lift bar, the movement of the tilt link bar causing the antenna to pivot as the antenna moves between the stowed position and the deployed position so that in the stowed position, the antenna faces downward.

9. The method of claim 8 wherein the actuator comprises a linear actuator motor.

10. The method of claim 8 wherein the lift bar is pivotably connected to a base between the first and second ends of the lift bar.

11. A satellite antenna system comprising:

a base;

an antenna having a front and a back; and an elevation mechanism moving the antenna between a deployed position and a stowed position, said elevation mechanism having:

(a) a linear actuator motor connected to the base;

(b) a tilt link bar having a first end pivotally connected to the back of the antenna and a second end pivotally connected to the base; and (c) a lift bar having a first end pivotally connected to the back of the antenna, a second end pivotally connected to and driven by the linear actuator motor, and a pivot connection point pivotally connected to the base between the first and second ends of the lift bar.

12. The system of claim 11 wherein movement of the linear actuator motor is in a substantially horizontal plane.

13. The system of claim 11 wherein the base further comprises an azimuth plate.

14. The system of claim 11 wherein the lift bar further comprises two segments extending from the pivot connection point to form an obtuse angle.

* * * * *